313-422 SR
5/16/78 OR 4,090,104

United States Patent [19] [11] 4,090,104
Vann et al. [45] May 16, 1978

[54] OPTICAL FIBER TELEVISION SCREEN

[76] Inventors: Clyde R. Vann; Roy R. Vann, both of Box 38, Artesia, N. Mex. 88210

[21] Appl. No.: 774,876

[22] Filed: Mar. 7, 1977

[51] Int. Cl.[2] ..... H01J 29/56
[52] U.S. Cl. ..... 313/422; 313/475; 358/242; 358/901; 350/96.27
[58] Field of Search ..... 358/200, 242, 901, 241; 313/372, 422, 475; 340/380; 350/96 BC

[56] References Cited

U.S. PATENT DOCUMENTS

| | | | |
|---|---|---|---|
| 2,825,260 | 3/1958 | O'Brien | 313/372 |
| 3,400,214 | 9/1968 | Hamann | 358/901 |
| 3,731,135 | 5/1973 | Iadicicco et al. | 313/422 |
| 3,840,701 | 10/1974 | Tomii et al. | 358/901 |

OTHER PUBLICATIONS

Frederick H. Nicoll, "Mural Television Display Using Fiber Optics" 9-26-58 RCA #188.

*Primary Examiner*—Robert L. Griffin
*Assistant Examiner*—Edward L. Coles
*Attorney, Agent, or Firm*—Marcus L. Bates

[57] ABSTRACT

Video Receiving Apparatus having a fiber optic display screen arranged substantially normally to a beam of electrons projected from an electron gun. The display screen compromises a plurality of optical fibers arranged in aligned relationship to form a bundle of parallel fibers which are extremely short in length. Each fiber has a light receiving face spaced from a light emitting face with there being sufficient light emitting faces to provide for the formation of a suitable image on a television screen. Each light receiving face is arranged at an angle respective to the beam of electrons which is less than the critical angle of the glass fiber. The axial center line of one end of each glass fiber lies normal to the viewing screen and laterally to the beam of electrons.

11 Claims, 8 Drawing Figures

FIG. 4
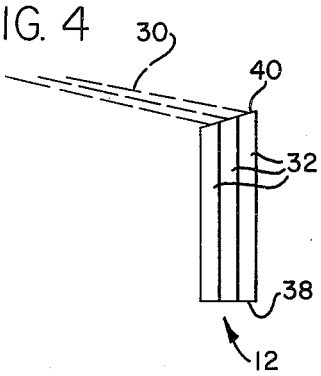
FIG. 5
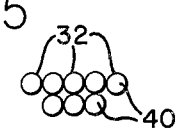
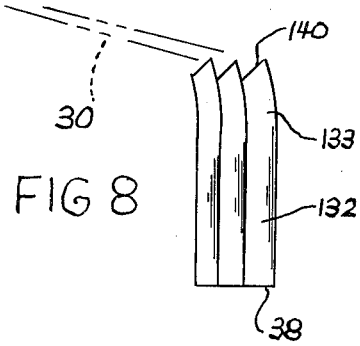
FIG 8
FIG. 6
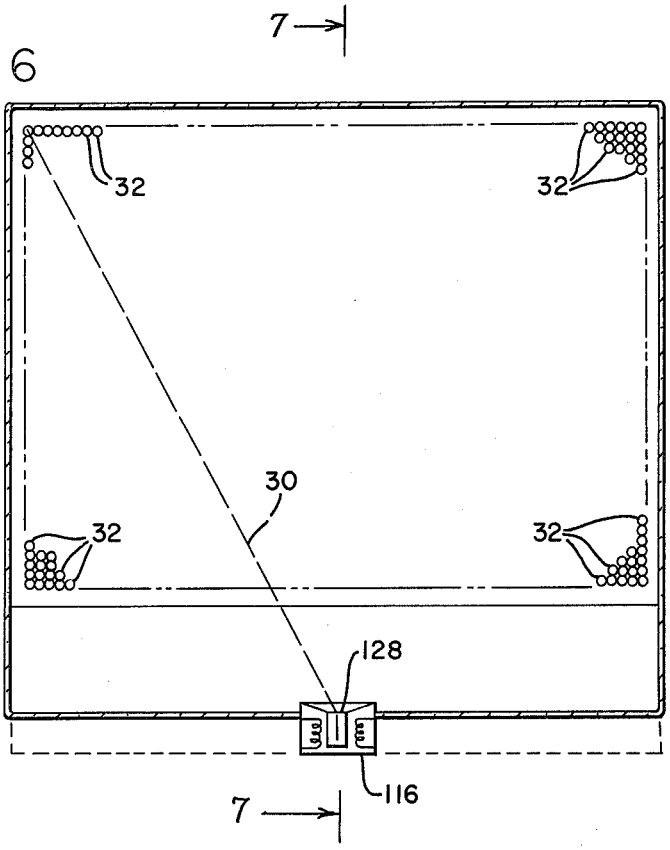
FIG. 7
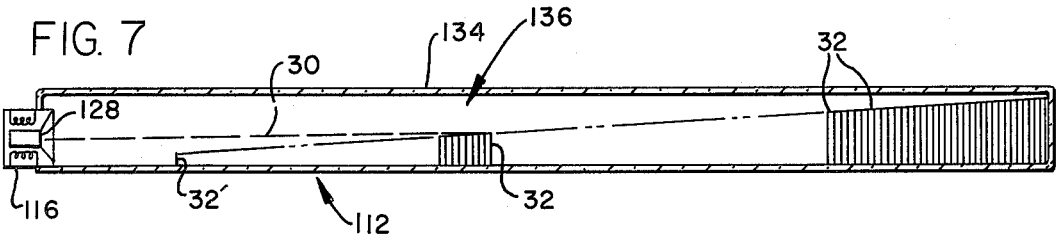

OPTICAL FIBER TELEVISION SCREEN

RELATED PRIOR ART

Okamuro; 3,473,872
Winik et al; 3,469,026
Conant; 3,275,743
Padgitt; 3,175,037
Sheldon; 2,877,368
O'Brien; 2,825,260

BACKGROUND OF THE INVENTION

The purpose of this invention is to effectively reduce the third dimensional space of conventional cathode ray tube devices. A thin television screen, hereinafter referred to as a TV screen, is desirable in portable TVs in order to reduce the overall size and thickness of the cabinet. Moreover, a thin TV screen is more attractive and can be mounted vertically to most any building wall structure in the manner of a framed picture.

A reduction in the size of a TV tube and cabinet requires less raw materials during fabrication and ultimately leads to a reduction in price. It is therefore desirable to have made available a TV screen of conventional viewing area which has been drastically reduced to one or two inches in thickness.

The thin screen of the present invention is realized by scanning the rear of the fiber optic screen at an acute angle. The fibers of the screen transmit the light from the light receiving face to the light emitting face of the individual glass fibers, with the light wave propagating along the fiber and reflecting at the boundary with very little loss, as in appreciated by those skilled in the art.

The geometry of the screen is of any reasonable configuration to present a practical and pleasing appearance to the viewer. The screen is essentially a bundle of glass fibers having one end orientated towards the electron gun and the remaining end orientated into a common plane respective to the ends of the adjacent fibers to thereby provide the aforesaid viewing screen.

SUMMARY OF THE INVENTION

This invention relates to a thin video receiver apparatus having a fiber optic display screen. The screen is comprised of a plurality of parallel optical fibers arranged into a bundle, with each individual fiber having a light receiving end spaced from a light emitting end. Each light emitting end is arranged respective to the remaining light emitting ends of the other fibers to provide the display screen.

The fibers are placed laterally to a means for projecting a beam of electrons towards the rear of the screen. This arrangement provides an extremely thin screen since the electron beam generating device can be housed in laterally spaced relation respective to the bundle.

Therefore, a primary object of the present invention is the provision of an extremely thin video receiver apparatus.

A further object of the present invention is the provision of a fiber optic display screen which utilizes an electron beam arranged laterally to the axial centerline of the individual fibers.

A still further object of the present invention is the provision of a fiber optic display screen which utilizes a laser beam for generation of a light source.

Another object of this invention is to provide an optical fiber television screen apparatus having a lateral light source while scans the light receiving end of the individual fibers such that the light source is effectively bent at an acute angle which approaches almost ninety degrees as it travels from the light generating source to the light emitting end of the fiber.

Still another object of the present invention is the provision of a television receiving tube having a fiber optic display screen wherein the individual glass fibers are orientated laterally to an electron beam so that the beam impinges on the light receiving end of the glass fiber, whereupon the light travels down the glass fiber to emerge from the light emitting end thereof.

The above objects are attained in accordance with the present invention by the provision of an apparatus which is fabricated in a manner substantially as described in the above abstract and summary.

These and various other objects and advantages of the invention will become readily apparent to those skilled in the art upon reading the following detailed description and claims and by referring to the accompanying drawings.

BRIEF DESCRIPTION OF THE DRAWINGS

FIG. 4 is an enlarged detailed view of part of the apparatus disclosed in FIGS. 1–3;

FIG. 5 is an enlarged end view of the apparatus disclosed in FIG. 4;

FIG. 6 is a cross-sectional view of a second embodiment of the present invention;

FIG. 7 is a cross-sectional view taken along line 7—7 of the apparatus disclosed in FIG. 6; and, FIG. 8 is a modification of the apparatus disclosed in FIG. 4.

DETAILED DESCRIPTION OF THE PREFERRED EMBODIMENT

Figure 1:
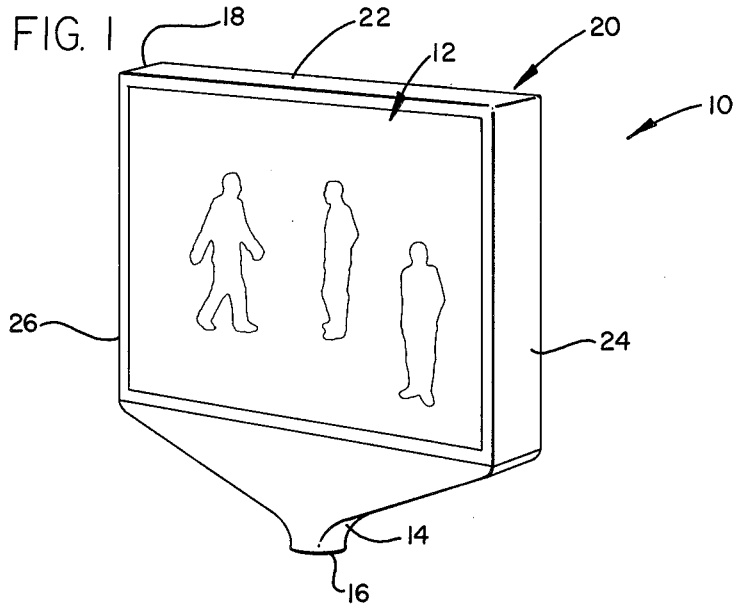
FIG. 1 is a front prospective view of a video receiver apparatus made in accordance with the present invention.

FIG. 1 discloses a video receiver apparatus 10 having a fiber optic display screen 12 mounted on the front thereof thereby enabling the screen to be viewed at a spaced distance therefrom. A lower housing 14 is supported at 16. The apparatus is extremely thin as evidenced by the shortness of the upper edge portion 18. The elongated narrow top 22 of the apparatus is spaced from the lower housing by opposed sidewalls 24 and 26.

Figure 2:
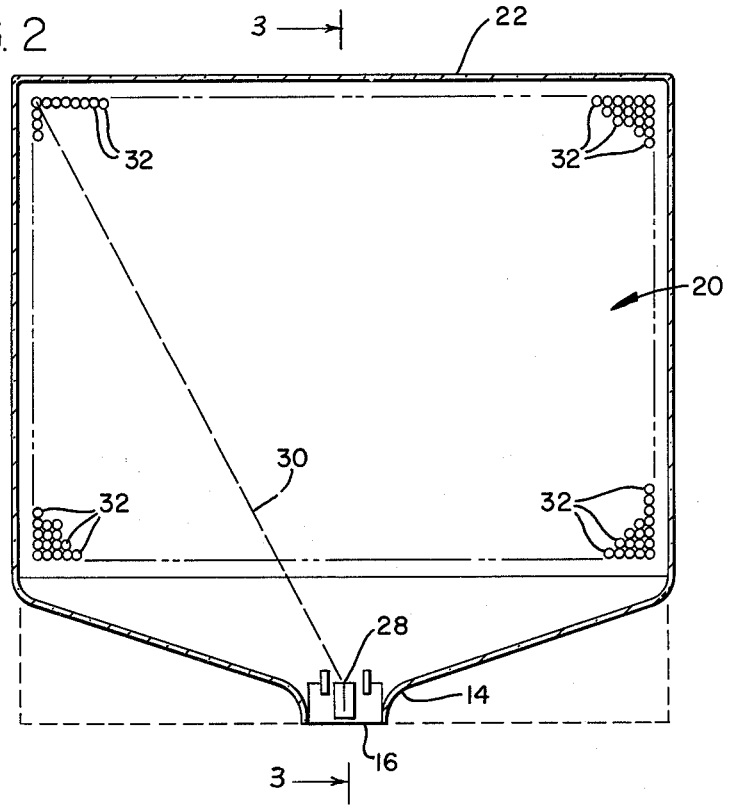
FIG. 2 is a longitudinal vertical cross-sectional view of the apparatus disclosed in FIG. 1.
Figure 3:
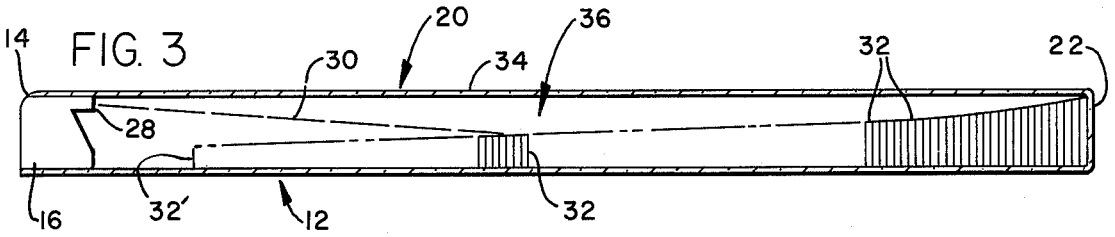
FIG. 3 is a cross-sectional view taken along line 3—3 of the apparatus disclosed in FIG. 2.

As schematically disclosed in FIGS. 2 and 3, an electron gun means 28 provides an electron beam which is deflected in two coordinates in proportion to the electrical potential applied to the usual deflection plates thereof, thereby causing the beam 30 to scan the inner or light receiving surface of a plurality of individual optical fibers 32. Means are provided to cause the sweep to extend from side to side as the beam contacts the rows of fibers near the gun.

The electron gun includes the usual heated cathode and focusing elements required to generate and project a beam of electrons onto the displaced light sensitive surface of the individual fiber optic elements.

The individual fiber elements are preferrably about 500 in number and are of a diameter which varies from several microns to several tens of microns. The optical glass preferably is coated with material having a lower refractive index so that light wave propagation along the guide reflects at the boundary with very slight loss. Interference of light between adjacent fibers can be minimized in accordance with the teachings set forth in U.S. Pat. No. 2,825,260 to O'Brien.

In FIG. 3, a rear wall 34 is spaced from the light receiving end of the fibers and completes the enclosure of the receiver apparatus. An evacuated space 36 is formed between the rear wall and the curved inner surface of the fibers. The light receiving inner surface of the individual fibers cooperate together to form a parabola, thereby increasing the angle of incidence between the beam and the light receiving face of the row of fibers furtherest removed from the gun.

As seen in FIGS. 4 and 5, together with other figures of the drawings, the individual fibers 32 are placed parallel to and adjacent one another. The fibers are each provided with a light emitting end 38 and a light receiving end 40. The end 40 includes the illustrated inclined face so that when a suitable beam of electrons 30 impinge upon the inclined face, light will be reflected along the interior of the fiber where it is effected at the light emitting end 38.

A phosphorescent glow effect can be achieved at 38 by the provision of various coatings thereon in accordance with the teachings of U.S. Pat. No. 2,825,260. The light receiving end 40 can by similarly coated with a suitable substance for enhancing the light producing capabilities of the screen.

In the second embodiment of the invention disclosed in FIGS. 6 and 7, the individual optical fibers 32 are arranged with the light receiving ends thereof disposed along the illustrated common inclined plane which commences near the top edge 22 of the apparatus and terminates at 32' in spaced relation respective to the electron gun 128.

The light emitting end of the fibers are placed adjacent to a glass screen 112 so that light reflected through the individual fiber is evidenced as a small spot of light at the screen, with the fibers jointly cooperating to produce a suitable image.

In the embodiment of FIG. 8, the marginal light receiving ends 133 of each fiber 132 is bent in a direction towards the gun, and the light receiving face 140 is formed at an angle greater than 90° respective to the axial centerline of the fiber, thereby further reducing the angle of incident between the face 140 and the beam 30 by this unique combination of expedients. The light emitting face 138 is formed normal to the axial centerline of the fiber, and jointly cooperates together to form a viewing screen as in the before described manner of the first embodiment.

In the embodiment of FIGS. 2 and 3 the scanned surface of the screen is cut parabolically to minimize the non-linearities in the beam stepping ratio as the acuteness of the angle of incidence of the scanning beam varies. The beam 30 must scan the same distance each sweep and therefore a linear ramp must be employed which steps up the deflection coil voltage to thereby progressively increase the angle each step towards the gun, with the widest angle being realized at the row of fibers immediately adjacent the gun.

The angle of the beam 30 respective to the longitudinal axis of the light receiving ends of the fibers varies from almost 90° at its furtherest reach to approximately 115° at its nearest reach. Hence, the beam is always disposed at an acute angle respective to the rear surface of the screen. This is so even in the instance when the parabolic rear surface continues to curve in an outward direction beyond the example of FIGS. 2 and 3. Hence, the term "laterally disposed" is used to point out and claim the relative position between the beam and the rear light receiving surface of the screen.

The diameter and number of fibers relate to the size and number of spots to be incorporated on the TV screen and usually number about 500 row/column.

The maximum entrance angle of the scanning electron beam 30 respective to the light receiving face 40 is known to those skilled in the art. The location of the electron gun respective to the light receiving surface of the screen must be arranged to avoid exceeding the critical angle where reflection of the beam will occur.

I claim:

1. A television receiving tube having a fiber optic display screen, comprising:

a rear wall spaced from a front wall, opposed end walls, an electron gun means positioned adjacent to one said end wall and located in such a manner to direct an electron beam towards the opposed end wall and onto the interior surface of said front wall;

said front wall includes a plurality of optical fibers having a light receiving end and a light emitting end, said fibers being arranged in side-by-side relationship with said light receiving ends forming said interior surface; each said fiber having said light emitting end arranged along a common plane for providing a screen upon which an image can be viewed; said fibers being arranged normally respective to the front wall and laterally respective to the scanning electron beam from said electron gun;

each light receiving ends of said fibers being formed into an inclined plane and orientated respective to the gun to receive an electron beam therefrom so that light is propagated along the interior of the fiber and is effected to illuminate said screen.

2. The apparatus of claim 1 wherein said electron gun means is located in laterally spaced relation to said screen.

3. The apparatus of claim 1 wherein the light receiving surface of said screen defines a parabola.

4. The apparatus of claim 1 wherein the light receiving surface of said screen defines an inclined plane which upwardly slopes in a direction away from said electron gun means.

5. The apparatus of claim 1 wherein said electron gun means is located in laterally spaced relation to said screen;

and wherein the light receiving surface of said screen defines a parabola.

6. The apparatus of claim 1 wherein said electron gun means is located in laterally spaced relation to said screen;

and wherein the light receiving surface of said screen defines an inclined plane which upwardly slopes in a direction away from said electron gun means.

7. Video receiver apparatus having a fiber optic display screen comprising a plurality of optical fibers arranged into a bundle of parallel fibers;

each fiber having a light receiving end spaced from a light emitting end, each light emitting end being arranged respective to the other light emitting ends to provide a display screen; gun means for projecting a beam of electrons towards said screen;

each light receiving end of each fiber being formed into a face which is at an angle other than 90° and which is inclined at an angle respective to said beam *j* each said fiber having an axial centerline which lies normal to said screen and laterally source of to said beam of electrons.

8. The apparatus of claim 7 and further including a housing having opposed end walls, a front and a rear wall;

said display screen forms said front wall of said housing;

said gun means being affixed to one said end wall in laterally spaced relation respective to said screen with said beam of electrons being projected towards said opposed end wall and towards the rear of said screen.

9. The apparatus of claim 7 wherein the light receiving surface of said screen defines a parabola.

10. The apparatus of claim 7 wherein the light receiving surface of said screen defines an inclined plane which upwardly slopes in a direction away from said electron gun means.

11. The apparatus of claim 7 and further including a housing having opposed end walls, a front and a rear wall;

said display screen forms said front wall of said housing;

said gun means being affixed to one said end wall in laterally spaced relation respective to said screen with said beam of electrons being projected towards said opposed end wall and towards the rear of said screen; and, wherein the light receiving surface of said screen defines a parabola.

* * * * *